US011655085B2

(12) United States Patent
Yambao et al.

(10) Patent No.: US 11,655,085 B2
(45) Date of Patent: May 23, 2023

(54) TAMPER RESISTANT STORAGE SYSTEMS FOR FOOD AND OTHER ITEMS

(71) Applicants: Alexander Yambao, Las Vegas, NV (US); Ashley Yambao, Las Vegas, NV (US); Maria Eleanor P. Yambao, Las Vegas, NV (US); Allen Yambao, Las Vegas, NV (US)

(72) Inventors: Alexander Yambao, Las Vegas, NV (US); Ashley Yambao, Las Vegas, NV (US); Maria Eleanor P. Yambao, Las Vegas, NV (US); Allen Yambao, Las Vegas, NV (US)

( * ) Notice: Subject to any disclaimer, the term of this patent is extended or adjusted under 35 U.S.C. 154(b) by 0 days.

(21) Appl. No.: 17/495,918

(22) Filed: Oct. 7, 2021

(65) Prior Publication Data

US 2022/0119176 A1 Apr. 21, 2022

Related U.S. Application Data

(63) Continuation-in-part of application No. 17/199,054, filed on Mar. 11, 2021, now abandoned, which is a continuation-in-part of application No. 17/073,969, filed on Oct. 19, 2020, now abandoned.

(51) Int. Cl.

| | |
|---|---|
| ***B65D 55/02*** | (2006.01) |
| ***B65D 33/34*** | (2006.01) |
| ***B65D 33/20*** | (2006.01) |

(52) U.S. Cl.

CPC ..... *B65D 55/024* (2013.01); *B65D 33/20* (2013.01); *B65D 33/34* (2013.01)

(58) Field of Classification Search

CPC ..... B65D 55/024; B65D 33/20; B65D 33/34
USPC ..... 383/5, 120
See application file for complete search history.

(56) References Cited

U.S. PATENT DOCUMENTS

| | | | | | |
|---|---|---|---|---|---|
| 2,126,203 | A * | 8/1938 | Miskella | B65D 33/18 | 383/7 |
| 2,409,100 | A * | 10/1946 | Brady | B65D 31/00 | 383/93 |
| 3,143,278 | A * | 8/1964 | Hiebert | B65D 33/18 | 383/62 |
| 3,669,254 | A * | 6/1972 | Chrysanthis | B65D 33/20 | 383/93 |
| 4,610,358 | A * | 9/1986 | Walter | B65D 77/14 | 383/905 |
| 4,709,397 | A * | 11/1987 | Voshall | B65D 33/34 | 229/80 |

(Continued)

*Primary Examiner* — Jes F Pascua

(57) ABSTRACT

A tamper-resistant, sealable container, comprising a container having a bottom portion, a top portion, and a plurality of sidewalls extending between the bottom portion and the top portion, wherein the bottom and top portions and sidewalls define an interior of the container and an exterior of the container; and a plurality of strips of self-sealing, pressure-sensitive adhesive disposed on surfaces of the container, wherein the strips of self-sealing, pressure-sensitive adhesive do not engage one another when the container is in an open configuration, wherein the strips of self-sealing, pressure-sensitive adhesive do engage one another when the container is in a closed configuration, and wherein the engagement of the strips of self-sealing pressure-sensitive adhesive with one another seals the container closed in a tamper-resistant manner.

5 Claims, 7 Drawing Sheets

(56) References Cited

U.S. PATENT DOCUMENTS

| | | | | |
|---|---|---|---|---|
| 6,149,304 | A * | 11/2000 | Hamilton | B65D 33/01 383/62 |
| 6,397,560 | B1 * | 6/2002 | Weder | B65D 33/20 53/399 |
| 2003/0063820 | A1 * | 4/2003 | Buchman | B65D 33/2508 383/120 |
| 2005/0031233 | A1 * | 2/2005 | Varanese | B65D 33/20 383/211 |
| 2009/0226121 | A1 * | 9/2009 | Veder | B65D 31/10 383/210 |
| 2010/0025456 | A1 * | 2/2010 | McCann | B65D 31/10 229/117.06 |
| 2017/0203901 | A1 * | 7/2017 | Komro | B32B 15/09 |
| 2018/0334292 | A1 * | 11/2018 | Tan | B65B 43/26 |

* cited by examiner

TAMPER RESISTANT STORAGE SYSTEMS FOR FOOD AND OTHER ITEMS

CROSS-REFERENCE TO RELATED APPLICATIONS

This patent application is a continuation-in-part of U.S. patent application Ser. No. 17/199,054 filed on Mar. 11, 2021 and entitled "Tamper Resistant Containers for Food and Other Items", which was a continuation-in-part of U.S. patent application Ser. No. 17/073,969 filed on Oct. 19, 2020 and entitled "Tamper Resistant Containers for Food and Other Items", the disclosures of which are hereby incorporated by reference herein in their entirety and made part of the present U.S. utility patent application for all purposes.

BACKGROUND

The disclosed inventive subject matter relates in general to storage systems, containers, and packages used for food, perishable items, and other items, and more specifically to tamper-resistant storage systems for use with carry-out, pick-up, and delivery services used for food and other items.

Carry-out, pick-up, and delivery systems and services used for food and other items are commonplace in modern society. However, such systems and services necessarily involve multiple individuals handling, packaging, and in some circumstances delivering, the food or other items. Customers and consumers of such systems and services are often understandably concerned about the integrity of the packaging that the food or other items is stored in prior to pick-up or delivery and about the accuracy and contents of an order. A purchase receipt is often attached to or included with food packaging that is picked-up or delivered. However, this receipt may become lost, detached, or otherwise separated from the food packaging. Additionally, the food packaging may be opened, damaged, or otherwise tampered with prior to delivery, resulting in customer concern and/or dissatisfaction. Accordingly, a food packaging system that utilizes or includes tamper-resistant features is highly desirable.

SUMMARY

The following provides a summary of certain example implementations of the disclosed inventive subject matter. This summary is not an extensive overview and is not intended to identify key or critical aspects or elements of the disclosed inventive subject matter or to delineate its scope. However, it is to be understood that the use of indefinite articles in the language used to describe and claim the disclosed inventive subject matter is not intended in any way to limit the described inventive subject matter. Rather the use of "a" or "an" should be interpreted to mean "at least one" or "one or more".

One implementation provides a first tamper-resistant, sealable container, comprising a container having a bottom portion, a top portion, and a plurality of sidewalls extending between the bottom portion and the top portion, wherein the bottom and top portions and sidewalls define an interior of the container and an exterior of the container; and a plurality of strips of self-sealing, pressure-sensitive adhesive disposed on surfaces of the container, wherein the strips of self-sealing, pressure-sensitive adhesive do not engage one another when the container is in an open configuration, wherein the strips of self-sealing, pressure-sensitive adhesive do engage one another when the container is in a closed configuration, and wherein the engagement of the strips of self-sealing pressure-sensitive adhesive with one another seals the container closed in a tamper-resistant manner. The container may further identifying indicia printed across the sealed portion of the container. The container may be a paper or plastic bag of the type used for storing and transporting food, groceries, and other items. The container may be a paper or plastic box of the type used for storing and transporting food, groceries, and other items. The adhesive may be a rubber-based or latex-based adhesive capable of adhering to itself.

Another implementation provides a second tamper-resistant, sealable container, comprising: a container having a closed bottom portion; a closeable top portion; two substantially flat side wall portions extending between the bottom portion and the top portion; and two pleated sidewall portions extending between the bottom portion and the top portion on either side of the flat sidewall portions, wherein each pleated sidewall portion includes a first section and a second section, and wherein the bottom portion, top portion, and sidewall portions define an interior of the container and an exterior of the container; two strips of adhesive disposed on the outer edges of the interior of each flat sidewall portion near the top portion of the container; a strip of adhesive disposed on the interior of the first section of each pleated sidewall portion and a strip of adhesive disposed on the interior of the second section of each pleated sidewall portion adjacent to the strip of adhesive disposed on the first section, wherein each strip of adhesive disposed on a pleated sidewall portion is positioned lower than the strips of adhesive disposed on the outer edges of each flat sidewall portion, wherein none of the adhesive strips engage one another when the container is in an open, unsealed configuration, wherein the adhesive strips on the outer edges of one flat sidewall portion engage the adhesive strips on the outer edges of the other flat sidewall portion when the container is in a closed, sealed configuration, wherein the adhesive strips on the first and second sections of each pleated sidewall portion engage one another when the container is in a closed, sealed configuration, and wherein the engagement of the strips of adhesive with one another seals the container closed in a tamper-resistant manner. The container may further identifying indicia printed across the sealed portion of the container. The container may be a paper or plastic bag of the type used for storing and transporting food, groceries, and other items. The adhesive may be a self-sealing, pressure-sensitive adhesive. The adhesive may be a rubber-based or latex-based adhesive capable of adhering to itself.

Still another implementation provides a third tamper-resistant storage system, comprising a tamper-resistant, sealable container, comprising a container having a closeable bottom portion; a closeable top portion; a first sidewall extending between the bottom portion and the top portion, wherein the first sidewall includes a bottom flap and a top flap; a second sidewall extending between the bottom portion and the top portion, wherein the second sidewall includes a bottom flap and a top flap; a third sidewall extending between the bottom portion and the top portion, wherein the third sidewall includes a bottom flap and a top flap; and a fourth sidewall extending between the bottom portion and the top portion, wherein the fourth sidewall includes a bottom flap and a top flap, wherein the bottom portion, the top portion, and the sidewall portions define an interior of the container and an exterior of the container; a strip of self-sealing, pressure-sensitive adhesive disposed on the outer surface of the top flap on the first sidewall, and a strip of self-sealing, pressure-sensitive adhesive disposed on the outer surface of the top flap on the third sidewall, which is located opposite the first sidewall; a strip of self-sealing, pressure-sensitive adhesive disposed on the inner surface of the top flap on the second sidewall, and a strip of self-sealing, pressure-sensitive adhesive disposed on the inner surface of the top flap on the fourth sidewall, which is located opposite the second sidewall, wherein the engagement of the strips of self-sealing, pressure-sensitive adhesive with one another seals the container closed in a tamper-resistant manner. The container may further identifying indicia printed across the sealed portion of the container. The container may further comprise a strip of self-sealing, pressure-sensitive adhesive disposed on the outer surface of the bottom flap on the first sidewall, and a strip of self-sealing, pressure-sensitive adhesive disposed on the outer surface of the bottom flap on the third sidewall, which is located opposite the first sidewall; and a strip of self-sealing, pressure-sensitive adhesive disposed on the inner surface of the bottom flap on the second sidewall, and a strip of self-sealing, pressure-sensitive adhesive disposed on the inner surface of the bottom flap on the fourth sidewall, which is located opposite the second sidewall. The container may be a paper or plastic box of the type used for storing and transporting food, groceries, and other items. The adhesive may be a rubber-based or latex-based adhesive capable of adhering to itself.

It should be appreciated that all combinations of the foregoing concepts and additional concepts discussed in greater detail below (provided such concepts are not mutually inconsistent) are contemplated as being part of the inventive subject matter disclosed herein and may be implemented to achieve the benefits as described herein. Additional features and aspects of the disclosed system, devices, and methods will become apparent to those of ordinary skill in the art upon reading and understanding the following detailed description of the example implementations. As will be appreciated by the skilled artisan, further implementations are possible without departing from the scope and spirit of what is disclosed herein. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more example implementations of the disclosed inventive subject matter and, together with the general description given above and detailed description given below, serve to explain the principles of the disclosed subject matter, and wherein.

DETAILED DESCRIPTION

Figure 1A:
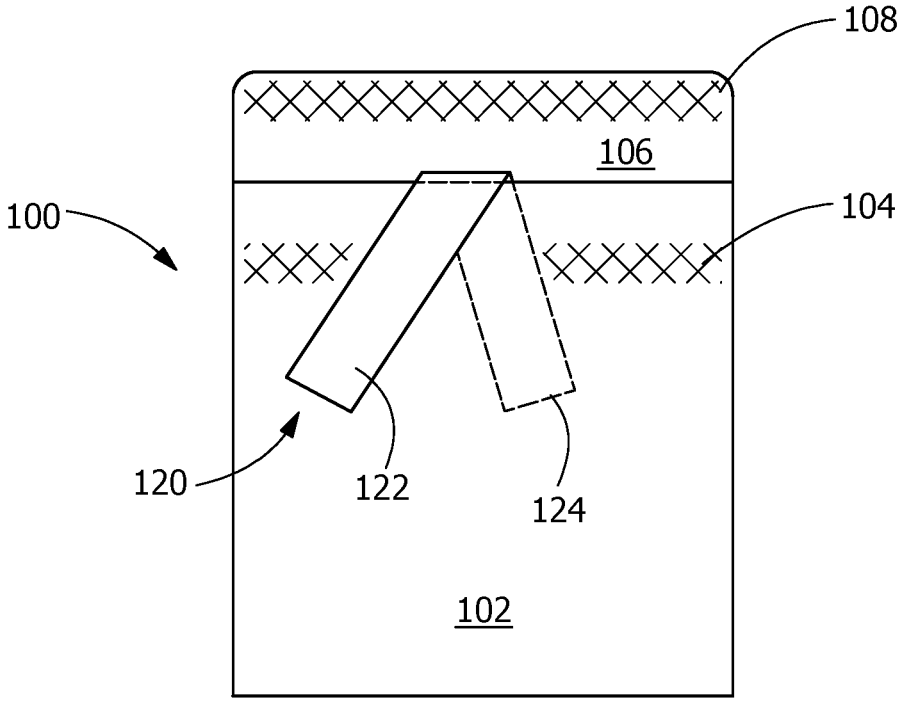
FIG. 1A depicts a first example implementation of the disclosed tamper-resistant containers, wherein the container is an envelope shown in an unsealed configuration.

Example implementations are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the disclosed inventive subject matter. Accordingly, the following implementations are set forth without any loss of generality to, and without imposing limitations upon, the claimed subject matter.

Figure 1B:
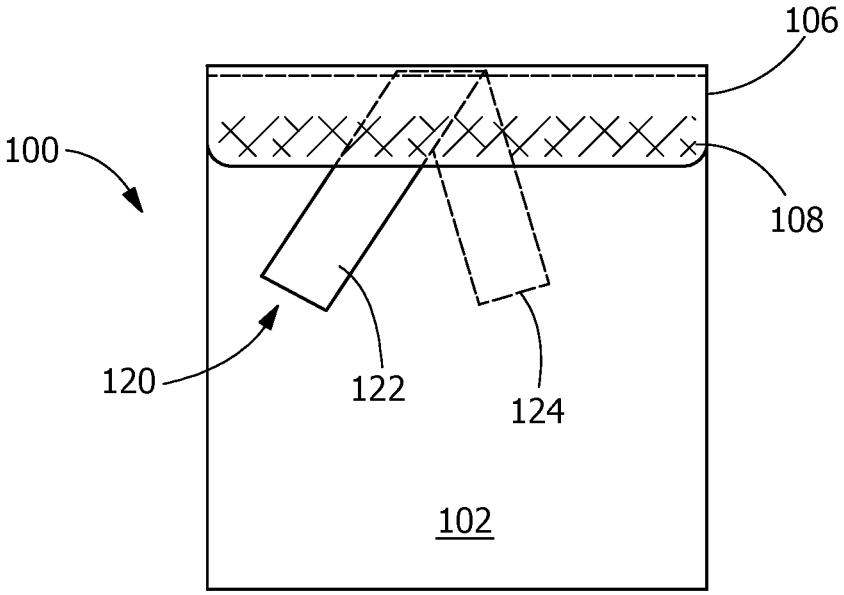
FIG. 1B depicts the example implementation of FIG. 1A in a sealed configuration with a portion of the paper receipt component being visible on the exterior of the tamper-resistance container.

FIG. 1A depicts a first example implementation of the disclosed tamper-resistant containers, wherein the container is an envelope shown in an unsealed configuration and FIG. 1B depicts the example implementation of FIG. 1A in a sealed configuration with a portion of the paper receipt component being visible on the exterior of the tamper-resistance container. In FIGS. 1A-1B, tamper-resistance container 100 includes an envelope, sack, or bag component 102 and a receipt component 120. Envelope, sack, or bag component 102 includes closed lower portion 104, middle portion 106, which accommodates various items for storage, and closeable upper portion 110. Adhesive 108 may be deposited on the upper area of middle portion 106 and adhesive 112 may be deposited on closeable upper portion 110. The adhesive allows container 100 to be sealed in a closed configuration simply by folding upper portion 110 onto middle portion 106 and applying pressure. In this implementation, receipt component 120 does not include adhesive, but rather is folded at a predetermined angle and inserted into container 100 prior to the closure and sealing thereof. Exterior portion 122, which includes identifying indicia (e.g., order contents, name of person ordering, delivery address, etc.) remains on the outside of container 100 while interior portion 124 remains within middle portion 106 after closure and sealing. In this manner, receipt component 120 cannot be removed or replaced without damaging the receipt itself or re-opening the sealed container, either of which would provide evidence of tampering to the customer. Various adhesives may be used with this example implementation including latex or rubber based adhesives or any other glue or adhesive material, including self-sealing materials, suitable for use with the disclosed tamper resistant containers.

Figure 2A:
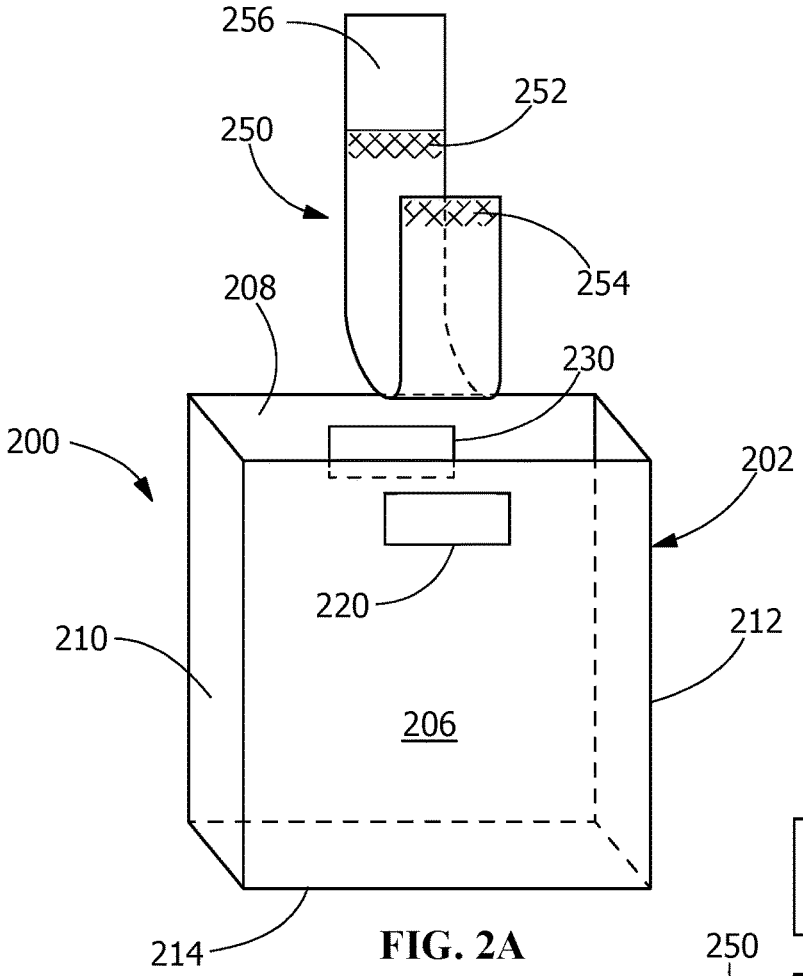
FIG. 2A depicts a second example implementation of the disclosed tamper-resistant containers, wherein the container is a paper bag shown in an open configuration.
Figure 2B:
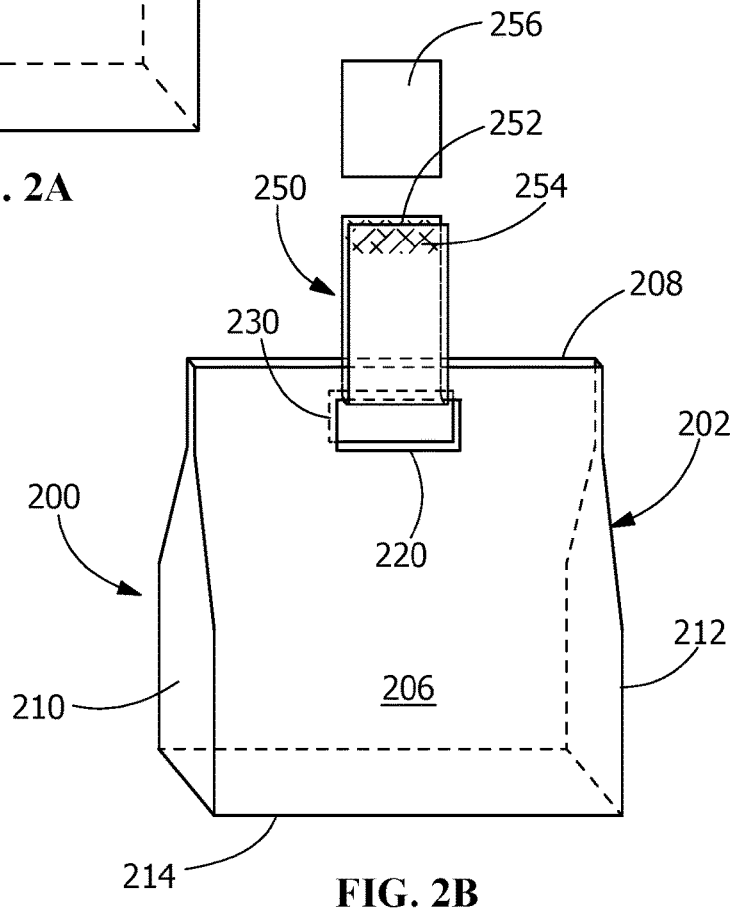
FIG. 2B depicts the example implementation of FIG. 2A shown in a closed or sealed configuration, wherein the paper receipt component has been used as a closure device.

FIG. 2A depicts a second example implementation of the disclosed tamper-resistant containers, wherein the container is a paper (or plastic) bag shown in an open configuration; and FIG. 2B depicts the example implementation of FIG. 2A shown in a closed or sealed configuration, wherein the paper receipt component has been used as a closure device. In FIGS. 2A-2B, tamper-resistance container 200 includes bag component 202 and receipt component 250. Bag component 202 includes closed bottom portion 204, middle portion 206, which accommodates various items for storage, front panel 208 in which first slot 210 is formed, rear panel 212, in which second slot 214 is formed, first side panel 216, and second side panel 218. Receipt component 250 includes first adhesive end 252 and second adhesive end 254, which are joined together when receipt component 250 is looped through first slot 210 and second slot 214 to form a closure device. When closed in this manner, container 200 cannot be re-opened without removing the receipt component, and receipt component 250 cannot be removed or replaced without damaging the receipt itself, which would provide evidence of tampering to the customer. Various adhesives may be used with this example implementation including latex or rubber based adhesives or any other glue or adhesive material, including self-sealing materials, suitable for use with the disclosed tamper resistant containers. Receipt component 250 may also include a detachable portion 256 that may be removed from the longer portion of receipt component 250 if the user of the container wishes to retain information printed thereon.

In another implementation, the disclosed tamper-resistant container is a plastic or paper bag or similar item that includes a row of apertures or holes formed in or near the upper, open edges thereof. These apertures or holes may be formed using a specialized manual or automated punch or other item capable of punching completely through the material of the bag. The apertures may be formed in the bag prior to the use of the bag (e.g., at the time the bag is manufactured) or the apertures may be formed at the point of purchase by a cashier or other person by using the described punch. The apertures may be any of a variety of shapes including circular, oval, square, rectangular, triangular, and trapezoidal. The bag is sealed with a receipt that is typically generated at the time the items placed within the bag are purchased. The receipt may be standard paper or a thermal type printable paper that further includes an adhesive that is applied directly onto one side of the receipt. The receipt may be provided in roll form or in other commonly used forms. The adhesive may be self-adhesive or a rubber or latex type adhesive that permanently seals the receipt to the material of bag and to the material of the receipt itself. After the items have been placed in the bag, the adhesive-bearing side of the receipt is placed over and across the apertures or holes, either in a horizontal or vertical orientation, such that the adhesive sticks to itself though the apertures or holes, as well as sticking directly to the material of the bag. By sealing the top edges of the bag in this manner, the sealed bag cannot be re-opened without damaging both the receipt and the material of the bag itself, making any tampering clearly apparent.

Figure 3A:
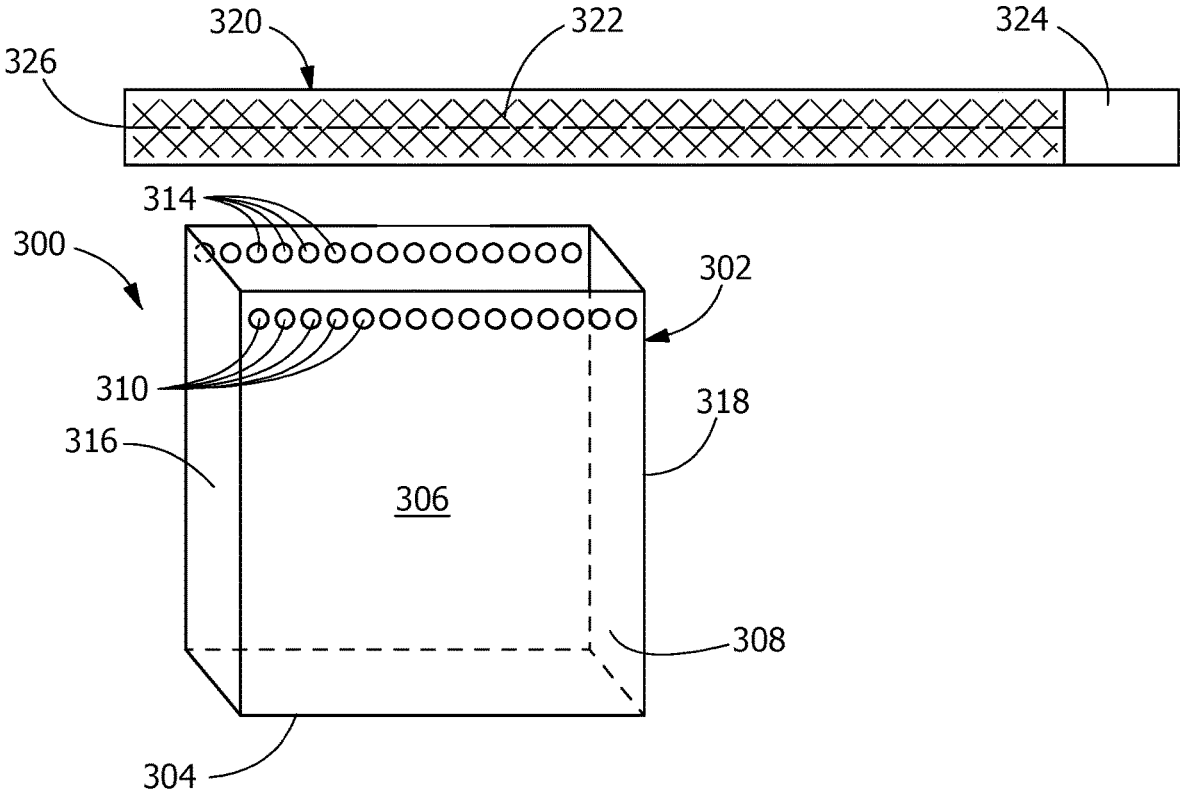
FIG. 3A depicts a third example implementation of the disclosed tamper-resistant containers, wherein the container is a paper bag shown in an open configuration and an adhesive-bearing paper receipt component is shown prior to placement around the upper portion of the bag.
Figure 3B:
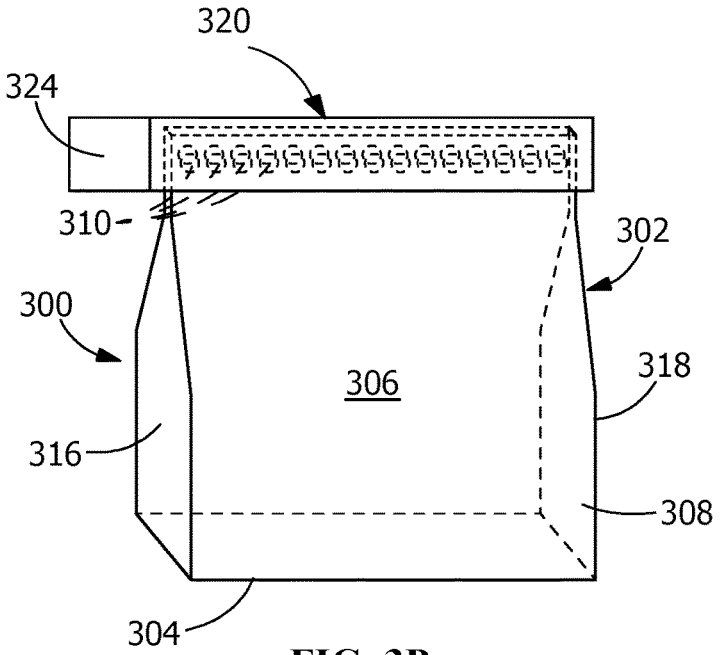
FIG. 3B depicts the example implementation of FIG. 3A shown in a closed or sealed configuration, wherein the paper receipt component has been used as a closure device.
Figure 3C:
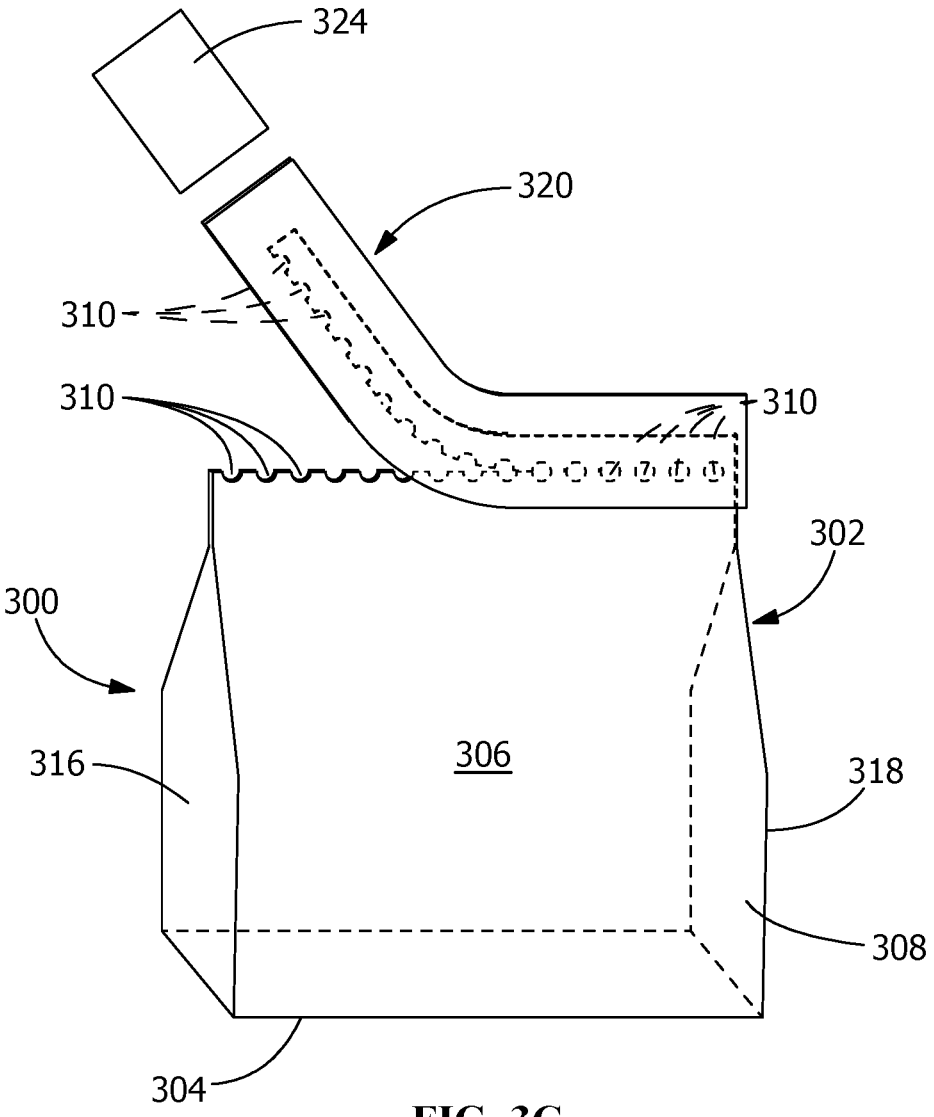
FIG. 3C depicts the example implementation of FIG. 3B, wherein the paper receipt component has been partially torn off the upper portion of the bag to unseal the container and allow access to the contents thereof.

FIG. 3A depicts a third example implementation of the disclosed tamper-resistant containers, wherein the container is a paper bag shown in an open configuration and an adhesive-bearing paper receipt component is shown prior to placement around the upper portion of the bag. FIG. 3B depicts the example implementation of FIG. 3A shown in a closed or sealed configuration, wherein the paper receipt component has been used as a closure device; and FIG. 3C depicts the example implementation of FIG. 3B, wherein the paper receipt component has been partially torn off the upper portion of the bag to unseal the container and allow access to the contents thereof. In FIGS. 3A-3C, tamper-resistant storage system 300 includes bag component 302 and receipt component 320. Bag component 302 includes closed bottom portion 304, middle portion 306, which accommodates various items for storage, front panel 308 in which apertures 310 are formed, rear panel 312, in which apertures 314 are formed in horizontal alignment with apertures 310, first side panel 316, and second side panel 318. Receipt component 320 includes adhesive 322 deposited on one side thereof. In FIGS. 3A-3C, apertures 310 and 314 are circular in shape and have been formed immediately adjacent to one another to create a perforation along the upper edge of bag component 302. Receipt component 320 includes adhesive deposited along the length of one side thereof and is long enough to fold completely in half and onto itself as shown in FIG. 3B, while leaving a slight overhang (see left side of 320). This overhang may be grasped and used to pull receipt component 320 upward such that the perforated top edge of bag component 302 tears neatly in a linear manner (see FIG. 3C) to unseal bag component 302. Receipt component 320 cannot be removed from bag component 302 without damaging the upper portion of the bag component, thereby making any tampering with the seal visible. Receipt component 320 may also include detachable portion 324 that may be removed from the longer portion of receipt component 320 if the user of the container wishes to retain information printed thereon. Additionally, as shown in FIG. 3A, receipt component 320 may include centrally located guideline 322 running lengthwise along receipt component 320 for facilitating proper positioning of receipt component 320 on the closeable upper portion of container.

Figure 4A:
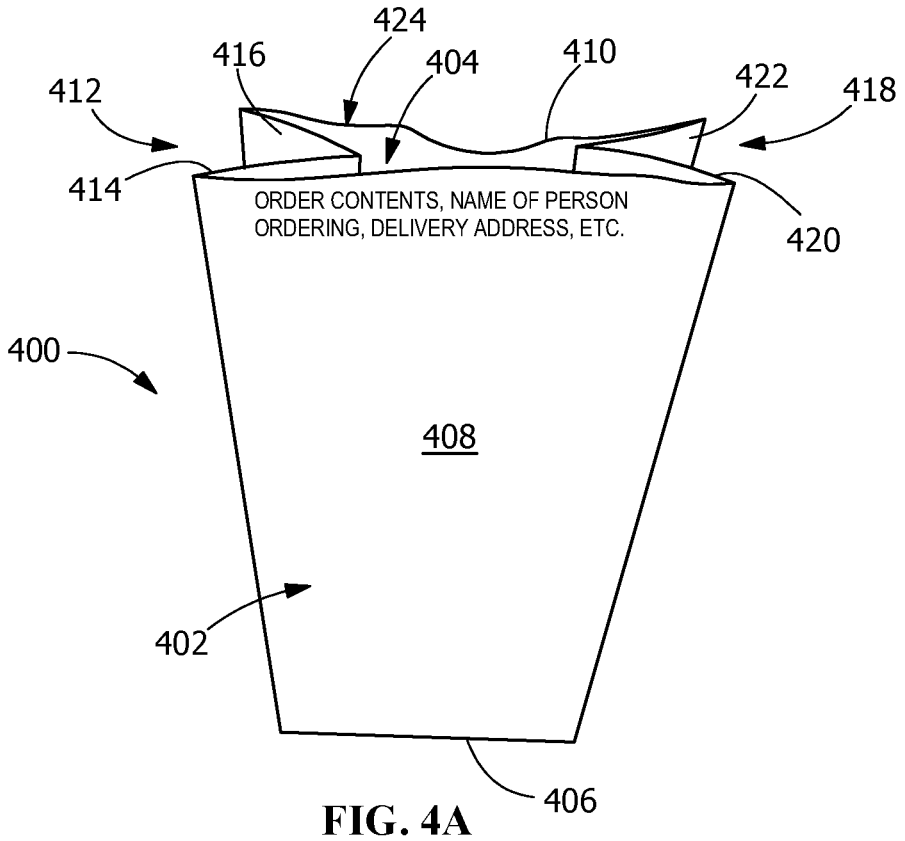
FIG. 4A depicts a fourth example implementation of the disclosed tamper-resistant containers, wherein the container is a tamper resistant paper bag of the type used to store and transport food and other items, and wherein a receipt component is not used for sealing the container.
Figure 4B:
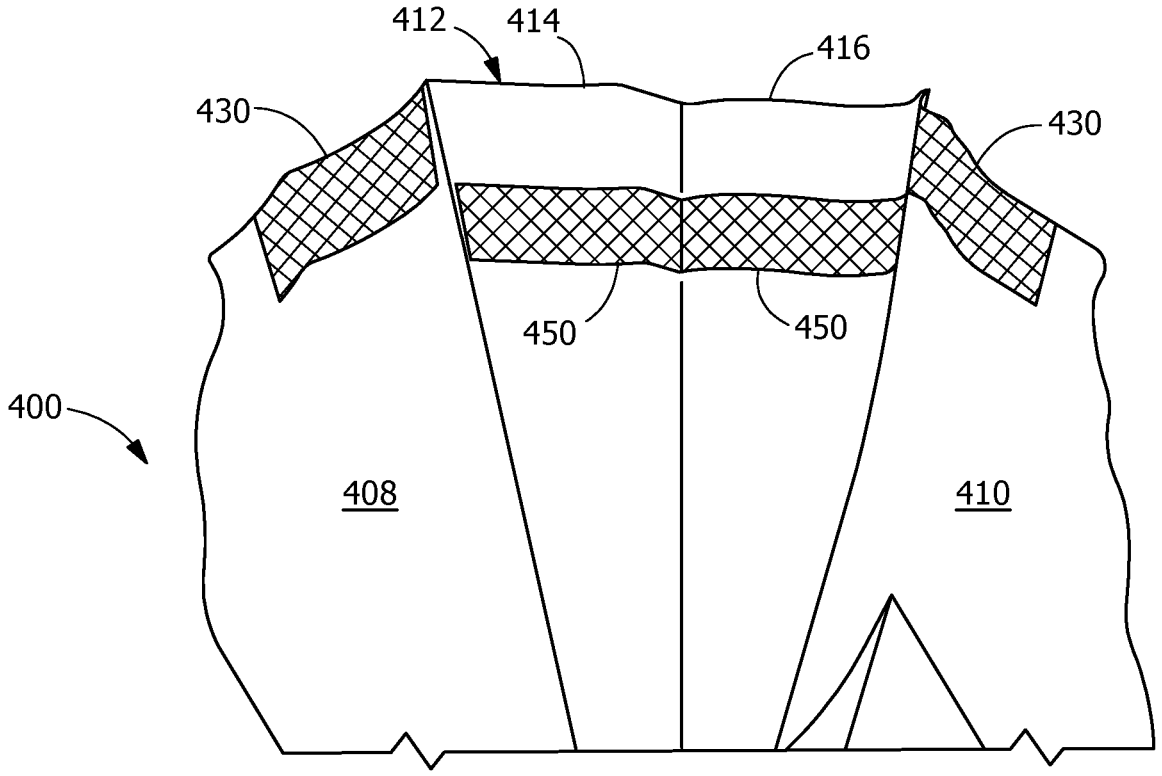
FIG. 4B depicts the container of FIG. 4A, wherein a plurality of adhesive strips have been deposited on the interior surfaces of the container in a manner that permits the strips of adhesive to not engage one another when the container is in an open configuration and to directly engage one another when the container is in a closed configuration, thereby sealing the container in a tamper-resistant manner.
Figure 4C:
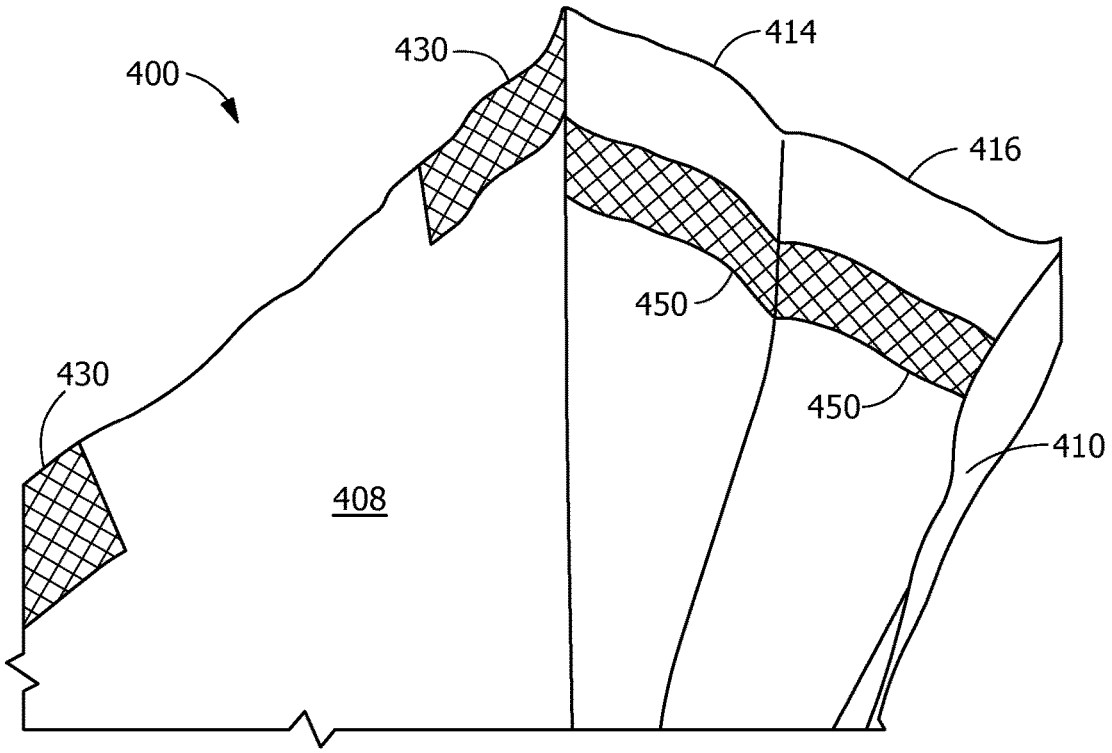
FIG. 4C is an alternate view of the interior of the container of FIG. 4B showing the positioning of the adhesive strips on the interior surfaces of the container.
Figure 4D:
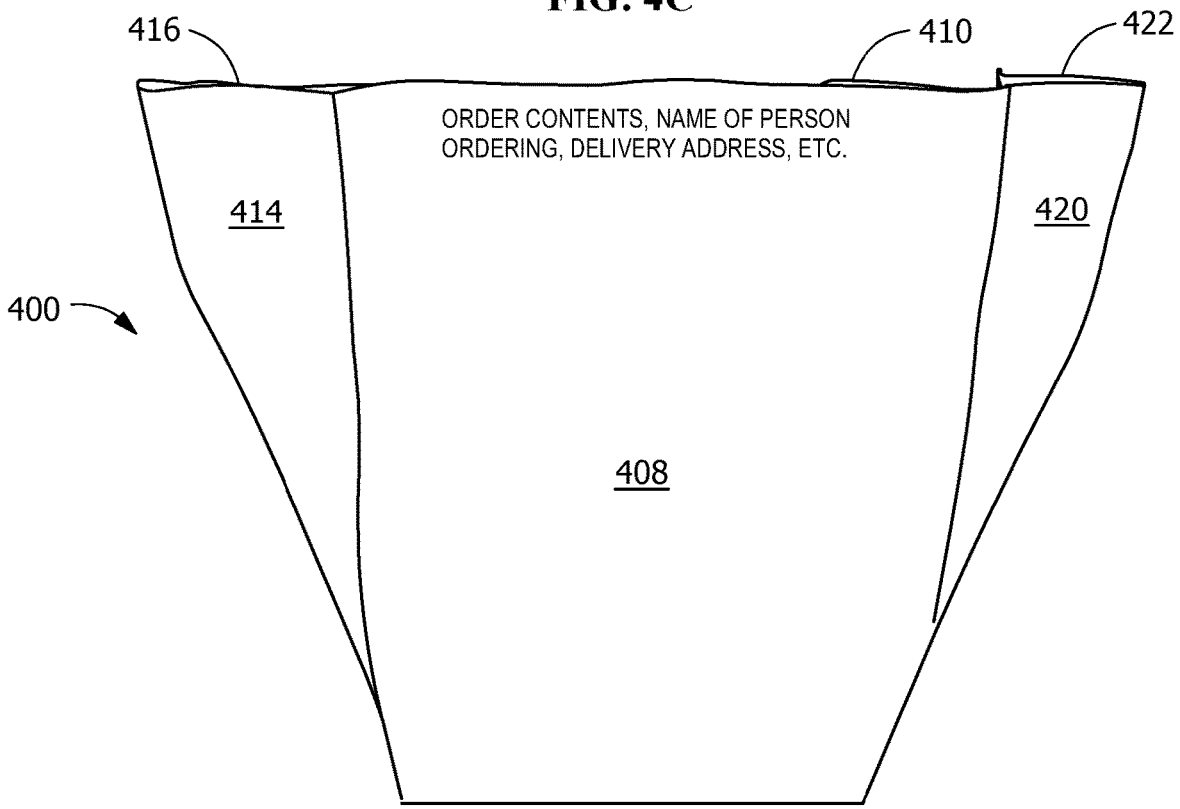
FIG. 4D depicts the container of FIG. 4A shown in a closed, sealed configuration.

FIG. 4A depicts a fourth example implementation of the disclosed tamper-resistant containers, wherein the container is a tamper resistant plastic or paper bag of the type used to store and transport food and other items, and wherein a receipt component is not used for sealing the container. FIG. 4B depicts the container of FIG. 4A, wherein a plurality of adhesive strips have been deposited on the interior surfaces of the container in a manner that permits the strips of adhesive to not engage one another when the container is in an open configuration and to directly engage one another when the container is in a closed configuration, thereby sealing the container in a tamper-resistant manner. FIG. 4C is an alternate view of the interior of the container of FIG. 4B showing the positioning of the adhesive strips on the interior surfaces of the container. In FIGS. 4A-4C, container 400 includes exterior region 402; interior region 404; closed bottom 406; first sidewall 408, which is substantially flat; second sidewall 410, which is substantially flat; third sidewall 412, which includes first pleated section 414 and second pleated section 416; fourth sidewall 418, which includes first pleated section 420 and second pleated section 422; and open top 424. Two strips of self-sealing adhesive 430 are disposed on the outer edges of the interior of each flat sidewall portion 408 and 410 near the top portion of container 400. A strip of self-sealing adhesive 450 is disposed on the interior of the first section (414, 420) of each pleated sidewall portion and a strip of self-sealing adhesive 450 is disposed on the interior of the second section (416, 422) of each pleated sidewall portion adjacent to the strip of self-sealing adhesive disposed on the first section (414, 420). Each strip of adhesive disposed on a pleated sidewall portion is positioned lower than the strips of adhesive disposed on the outer edges of each flat sidewall portion such that the various strips of adhesive do not overlap. None of the adhesive strips engage one another when the container is in an open, unsealed configuration (see FIG. 4A-4C). The adhesive strips 430 on the outer edges of one flat sidewall portion engage the adhesive strips 430 on the outer edges of the other, opposite, flat sidewall portion when the container is in a closed, sealed configuration, and the adhesive strips 450 on the first and second sections of each pleated sidewall portion engage one another when the container is in a closed, sealed configuration (see FIG. 4D). The engagement of the strips of adhesive with one another seals the container closed in a tamper-resistant manner because any attempt to open the sealed container will visibly damage the material of the container due to the permanent nature of the bond formed between the strips of adhesive.

Figure 5A:
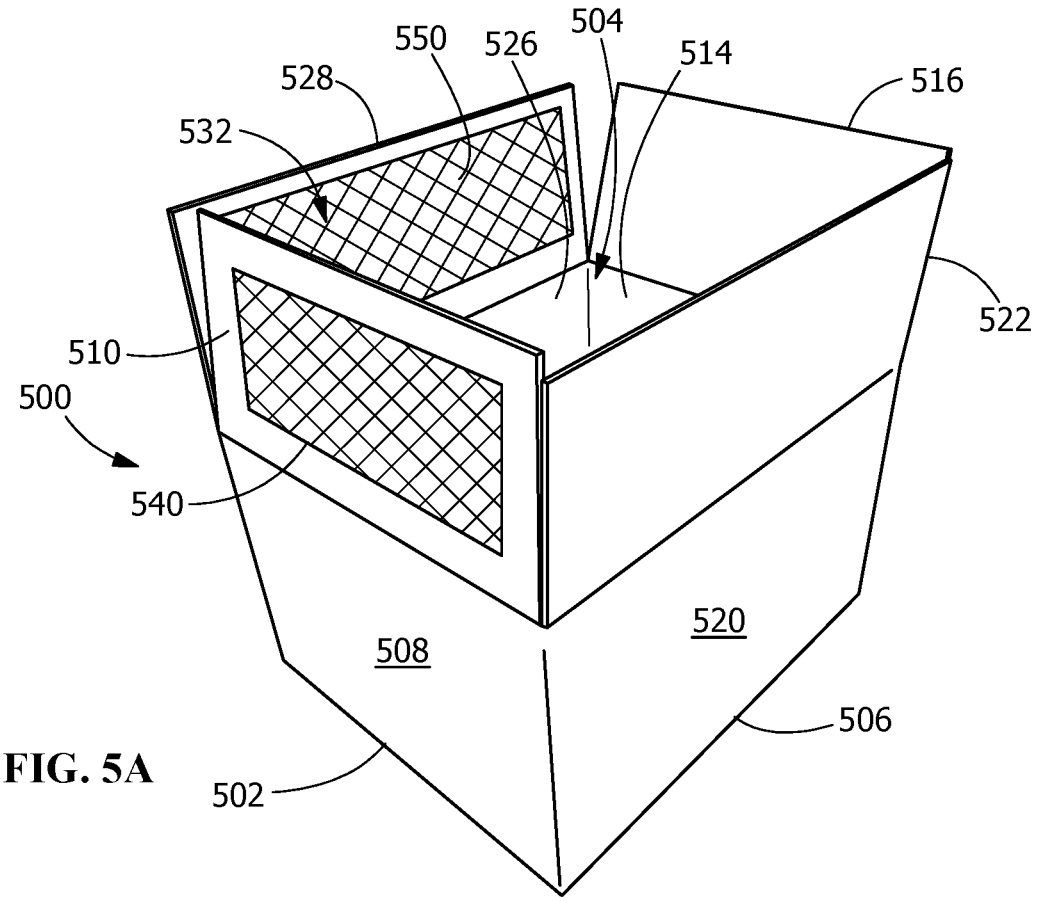
FIG. 5A depicts a fifth example implementation of the disclosed tamper-resistant containers, wherein the container is a tamper resistant cardboard box of the type used to store and transport food and other items, wherein a receipt component is not used for sealing the container, and wherein a plurality of adhesive strips have been deposited on certain surfaces of the upper and lower flaps of the box for allowing the box to be closed and sealed in a tamper-resistant manner.
Figure 5B:
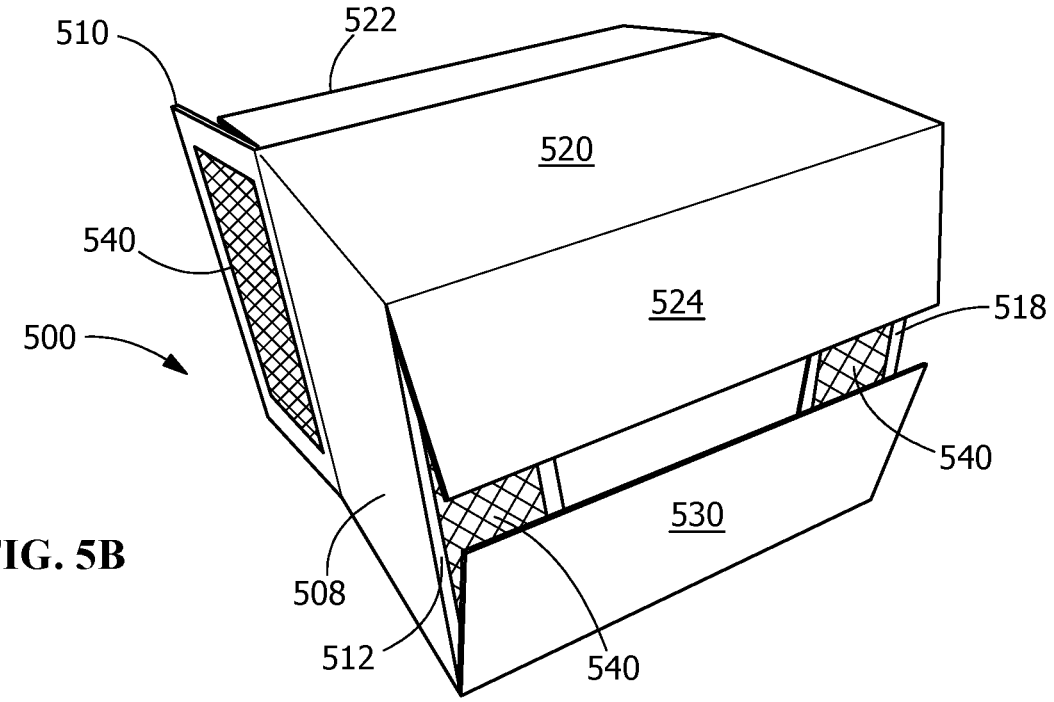
FIG. 5B depicts the container of FIG. 5A shown in a partially closed configuration.

FIG. 5A depicts a fifth example implementation of the disclosed tamper-resistant containers, wherein the container is a tamper resistant plastic or cardboard box of the type used to store and transport food and other items, wherein a receipt component is not used for sealing the container, and wherein a plurality of adhesive strips have been deposited on certain surfaces of the upper and lower flaps of the box for allowing the box to be closed and sealed in a tamper-resistant manner. FIG. 5B depicts the container of FIG. 5A shown in a partially closed configuration. In FIGS. 5A-5B, container 500 includes exterior region 502; interior region 504; closeable bottom 506; first sidewall 508, which includes upper flap 510 and lower flap 512; second sidewall 514, which includes upper flap 516 and lower flap 518; third sidewall 520 which includes upper flap 522 and lower flap 524; fourth sidewall 526, which includes upper flap 528 and lower flap 530, and open top 532, which may be sealed in a tamper-resistant manner. Strips of self-sealing adhesive 540 are deposited on the exterior of upper flaps 510 and 516 and, optionally, on the exterior of lower flaps 512 and 518. Likewise, strips of self-sealing adhesive 550 are deposited on the interior of upper flaps 522 and 528 and, optionally, on the interior of lower flaps 524 and 530. In some implementations, the adhesive used on the lower flaps is not a self-sealing adhesive. Container 500 is sealed by simply pressing adhesive strips 540 and 550 together to form a bond. The engagement of the strips of adhesive with one another seals the container closed in a tamper-resistant manner because any attempt to open the sealed container will visibly damage the material of the container due to the permanent nature of the bond formed between the strips of adhesive.

The implementations shown in FIGS. 4A-4C and 5A-5B and described above typically use one or more commercially available self-sealing adhesives, such as CASA 101 Self Sealing Adhesive (Casa Adhesives, Inc.; Calhoun, Ga.), to create permanent bond between the sections of the container being joined together to seal the container in a tamper-resistant manner. A self-sealing adhesive is a pressure sensitive adhesive that can form a strong bond with itself and with another substrate. A pressure-sensitive adhesive (also referred to a PSA or self-stick adhesive) is a type of non-reactive adhesive which forms a bond when pressure is applied to bond the adhesive with a surface. No solvent, water, or heat is needed to activate the adhesive. As the name "pressure-sensitive" indicates, the degree of bond is influenced by the amount of pressure which is used to apply the adhesive to the surface. Surface factors such as smoothness, surface energy, removal of contaminants, etc. are also important with regard to proper bonding. PSAs are usually designed to form a bond and hold properly at room temperatures and typically reduce or lose their tack at low temperatures and reduce their shear holding ability at high temperatures. "Permanent" pressure-sensitive adhesives are initially pressure-sensitive and removable (for example, to relabel mislabeled goods), but after hours or days change their properties by becoming less or not viscous, or by increasing bond strength such that the bond becomes permanent.

As previously stated and as used herein, the singular forms "a," "an," and "the," refer to both the singular as well as plural, unless the context clearly indicates otherwise. The term "comprising" as used herein is synonymous with "including," "containing," or "characterized by," and is inclusive or open-ended and does not exclude additional, unrecited elements or method steps. Although many methods and materials similar or equivalent to those described herein can be used, particular suitable methods and materials are described herein. Unless context indicates otherwise, the recitations of numerical ranges by endpoints include all numbers subsumed within that range. Furthermore, references to "one implementation" are not intended to be interpreted as excluding the existence of additional implementations that also incorporate the recited features. Moreover, unless explicitly stated to the contrary, implementations "comprising" or "having" an element or a plurality of elements having a particular property may include additional elements whether or not they have that property.

Underlined and/or italicized headings and subheadings are used for convenience only, do not limit the disclosed subject matter, and are not referred to in connection with the interpretation of the description of the disclosed subject matter. All structural and functional equivalents to the elements of the various implementations described throughout this disclosure that are known or later come to be known to those of ordinary skill in the art are expressly incorporated herein by reference and intended to be encompassed by the disclosed subject matter. Moreover, nothing disclosed herein is intended to be dedicated to the public regardless of whether such disclosure is explicitly recited in the above description.

There may be many alternate ways to implement the disclosed inventive subject matter. Various functions and elements described herein may be partitioned differently from those shown without departing from the scope of the disclosed inventive subject matter. Generic principles defined herein may be applied to other implementations. Different numbers of a given module or unit may be employed, a different type or types of a given module or unit may be employed, a given module or unit may be added, or a given module or unit may be omitted.

It should be appreciated that all combinations of the foregoing concepts and additional concepts discussed in greater detail herein (provided such concepts are not mutually inconsistent) are contemplated as being part of the disclosed inventive subject matter. All combinations of claimed subject matter appearing at the end of this disclosure are contemplated as being part of the inventive subject matter disclosed herein. While the disclosed inventive subject matter has been illustrated by the description of example implementations, and while the example implementations have been described in certain detail, there is no intention to restrict or in any way limit the scope of the appended claims to such detail. Additional advantages and modifications will readily appear to those skilled in the art. Therefore, the disclosed inventive subject matter in its broader aspects is not limited to any of the specific details, representative devices and methods, and/or illustrative examples shown and described. Accordingly, departures may be made from such details without departing from the spirit or scope of the general inventive concept.

What is claimed:

1. A tamper-resistant, sealable container, comprising:

(a) a container having a closed bottom portion; a closeable top portion; two substantially flat side wall portions extending between the bottom portion and the top portion; and two pleated sidewall portions extending between the bottom portion and the top portion on either side of the flat sidewall portions, wherein each pleated sidewall portion includes a first section and a second section, and wherein the bottom portion, top portion, and sidewall portions define an interior of the container and an exterior of the container;

(b) two strips of adhesive disposed on the outer edges of the interior of each flat sidewall portion near the top portion of the container;

(c) a strip of adhesive disposed on the interior of the first section of each pleated sidewall portion and a strip of adhesive disposed on the interior of the second section of each pleated sidewall portion adjacent to the strip of adhesive disposed on the first section, wherein each strip of adhesive disposed on a pleated sidewall portion is positioned lower than the strips of adhesive disposed on the outer edges of each flat sidewall portion, (d) wherein none of the adhesive strips engage one another when the container is in an open, unsealed configuration, (e) wherein the adhesive strips on the outer edges of one flat sidewall portion engage the adhesive strips on the outer edges of the other flat sidewall portion when the container is in a closed, sealed configuration, (f) wherein the adhesive strips on the first and second sections of each pleated sidewall portion engage one another when the container is in a closed, sealed configuration, and (g) wherein the engagement of the strips of adhesive with one another seals the container closed in a tamper-resistant manner.

2. The container of claim 1, further comprising identifying indicia printed across the sealed portion of the container.

3. The container of claim 1, wherein the container is a paper or plastic bag of the type used for storing and transporting food, groceries, and other items.

4. The container of claim 1, wherein the adhesive is self-sealing, pressure-sensitive adhesive.

5. The container of claim 1, wherein the adhesive is a rubber-based or latex-based adhesive capable of adhering to itself.

* * * * *